United States Patent [19]

Yakuwa et al.

[11] Patent Number: 4,862,369

[45] Date of Patent: Aug. 29, 1989

[54] ELECTRONICALLY-CONTROLLED FUEL INJECTION SYSTEM

[75] Inventors: Masahiko Yakuwa, Tochigi; Yoshio Suzuki, Saitama, both of Japan

[73] Assignee: Honda Giken Kogyo Kabushiki Kaisha, Tokyo, Japan

[21] Appl. No.: 93,878

[22] Filed: Sep. 8, 1987

[30] Foreign Application Priority Data

Sep. 8, 1986 [JP] Japan ..... 61-209627

[51] Int. Cl.[4] ..... F02D 41/18

[52] U.S. Cl. ..... 364/431.07; 364/431.05; 123/487; 123/492; 123/493

[58] Field of Search ..... 364/431.07, 431.05; 123/487, 492, 493

[56] References Cited

U.S. PATENT DOCUMENTS

| | | | |
|---|---|---|---|
| 4,389,997 | 6/1983 | Nakano et al. | 123/492 |
| 4,667,631 | 5/1987 | Kinugasa | 364/431.07 |
| 4,685,436 | 8/1987 | Oba | 123/492 |

FOREIGN PATENT DOCUMENTS

| | | |
|---|---|---|
| 0150048 | 9/1983 | Japan . |
| 0150049 | 9/1983 | Japan . |

*Primary Examiner*—Parshotam S. Lall
*Assistant Examiner*—V. N. Trans
*Attorney, Agent, or Firm*—Lyon & Lyon

[57] ABSTRACT

An electronically-controlled fuel injection system having a synchronous counter which receives main injection time data corresponding to an amount of fuel to be injected synchronously to engine revolutions, and an asynchronous counter which receives increment injection time data corresponding to an amount of fuel to be injected at a selected time interval asynchronously to the engine revolutions, wherein the synchronous counter is operated for a period of time equal to the main injection time data upon receiving a synchronous signal which is generated synchronously to the engine revolutions, while the asynchronous counter is operated for a period of time equal to the increment injection time data upon receiving an asynchronous signal which is generated at the selected time interval, so as to open a fuel injection valve by pulses which are output from the respective counters during the operations thereof. The electronically-controlled fuel injection system is provided with timers which ad a predetermined period of time after the end of the operation of each of said respective counters, and delay means operating when, during the operation of one of the two counters, a synchronous signal or an asynchronous signal for operating the other counter has been generated to delay the input of the signal to the other counter until the timekeeping of the timer ends.

3 Claims, 1 Drawing Sheet

ELECTRONICALLY-CONTROLLED FUEL INJECTION SYSTEM

The present invention relates to an electronically-controlled fuel injection system which is chiefly applied to vehicular engines.

Heretofore, there has been known a system of this type comprising a synchronous counter which receives main injection time data corresponding to an amount of fuel to be injected synchronously to engine revolutions, and an asynchronous counter which receives increment injection time data corresponding to an amount of fuel to be injected at a selected time interval asynchronously to the engine revolutions, wherein the synchronous counter is operated for a period of time equal to the main injection time data upon receiving a synchronous signal which is generated synchronously to the engine revolutions, while the asynchronous counter is operated for a period of time equal to the increment injection time data upon receiving an asynchronous signal which is generated at the selected time interval, so as to open a fuel injection valve by the operations of the respective counters. In this case, when during the operation of one of the two counters, for example, the operation of the synchronous counter, the asynchronous signal is generated to operate the asynchronous counter, both the counters operate overlapping in time, and an actual increment injection period of time is shortened by the overlapping time. A system wherein, in order to solve this drawback, the fuel injection valve is opened longer in correspondence with the overlapping time has been known from the official gazette of Japanese Patent Application Publication No. 17939/1985.

Meanwhile, during the operation of each counter, a pulse as shown in FIG. 4 is output from the counter, and the fuel injection valve is opened by this pulse. However, when a battery voltage lowers, the rise of the pulse lags as indicated by a phantom line, and the opening period of time of the fuel injection valve shortens as compared with the operating period of time of the counter. In this regard, there has been known a measure wherein the counter is supplied with injection time data obtained in such a way that a correction time $\Delta T$ dependent upon the battery voltage is added to a desired injection time T, whereby the lag of the rise of the pulse is compensated by operating the counter superfluously for $\Delta T$, and the opening time of the fuel injection valve is controlled so as to equalize to T. For the situation as in the above prior art where, when the synchronous counter and the asynchronous counter have operated in overlapping fashion, the fuel injection valve is opened longer for the overlapping period of time. Then, letting $T_1$ denote the desired main injection time and $T_2$ denote the desired increment injection time, a pulse of a duration as shown in FIG. 5 obtained by simply adding the operating time $T_1+\Delta T$ of the synchronous counter and that $T_2+\Delta T$ of the asynchronous counter is impressed on the fuel injection valve. As a result, the opening time of the fuel injection valve actually contributing to fuel feed becomes $T_1+T_2+\Delta T$, and the fuel is injected excessively in correspondence with $\Delta T$.

SUMMARY OF THE INVENTION

The present invention has for its object to solve such a problem, and to provide a system which can inject fuel accurately without excess or deficiency.

The present invention for accomplishing the object is characterized by providing timers which add a predetermined period of time after the ends of operations of a synchronous counter and an asynchronous counter, and delay means operating when, during the operation of one of the two counters, a synchronous signal or an asynchronous signal for operating the other counter has been generated, to delay in input of the signal to the other counter until the timekeeping of the timer ends.

Assuming that the asynchronous signal have been generated during the operation of the synchronous counter, this signal is input to the asynchronous counter at the point of time at which the timekeeping of the predetermined time t by the timer ends after the end of the operation of the synchronous counter. Eventually, a fuel injection valve is supplied with a pulse from the asynchronous counter after the output of the synchronous counter has fallen into a low level owing to the end of the operation thereof, as illustrated in FIG. 3. Accordingly, when the main injection time data is set at $T_1+\Delta T$ and the increment injection time data is set at $T_2+\Delta T$ as stated above, the total opening time of the fuel injection valve actually contributing to fuel feed becomes the desired $T_1+T_2$, and the fuel is not injected excessively in correspondence with $\Delta T$ as in the prior art.

DESCRIPTION OF THE PREFERRED EMBODIMENT

Figure 1:
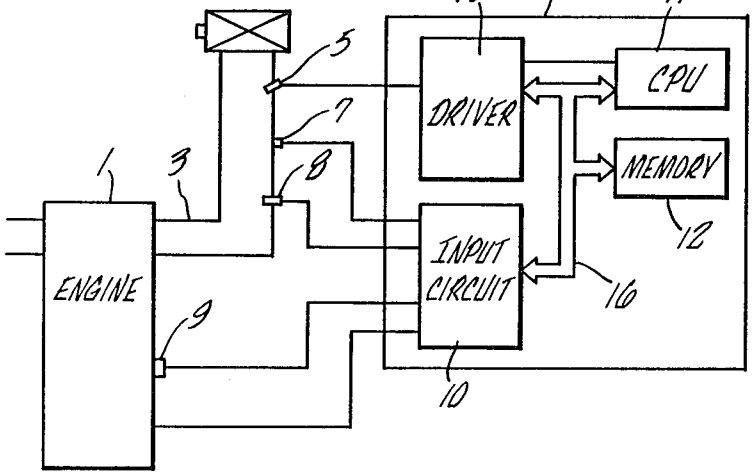
FIG. 1 is a general block diagram of an embodiment of a system according to the present invention.
Figure 5:
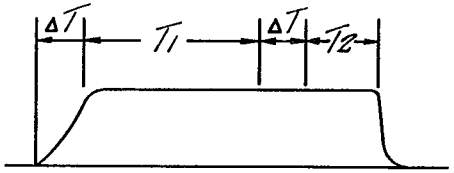
FIG. 5 is a diagram showing a pulse in a prior art which is impressed on a fuel injection valve.
Figure 4:
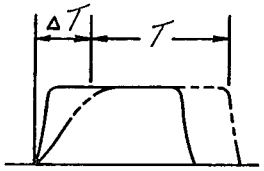
FIG. 4 is a diagram showing the waveform of a pulse which is output from each counter.

Referring to FIG. 1, numeral 1 designates an engine, and numeral 2 a control circuit which is constructed of a microcomputer. A fuel injection valve 5, which is disposed upstream of a throttle valve 4 in the suction passage 3 of the engine 1, is controlled to open and close by the control circuit 2.

The control circuit 2 includes therein an input circuit 10 which receives signals from sensors such as a crank angle sensor 6, a throttle opening degree sensor 7, a suction-pipe absolute pressure sensor 8 and a coolant temperature sensor 9; a central processing unit ("CPU") 11; a memory 12, and a driver circuit 13 for the fuel injection valve 5. The CPU 11 calculates a main injection time $T_1$ which corresponds to an amount of fuel to be injected synchronously to engine revolutions, for example, an amount of fuel conforming to an amount of suction air, an increment injection time $T_2$ which corresponds to an amount of fuel to be injected at a predetermined time interval asynchronously to the engine revolutions, for example, an amount of fuel for an accelerating increment, and a compensation time $\Delta T$ which depends upon a battery voltage and which serves to compensate the lag of the rise of a pulse, so as to generate main injection time data with $\Delta T$ added to $T_1$ and increment injection time data with $\Delta T$ added to $T_2$.

Figure 2:
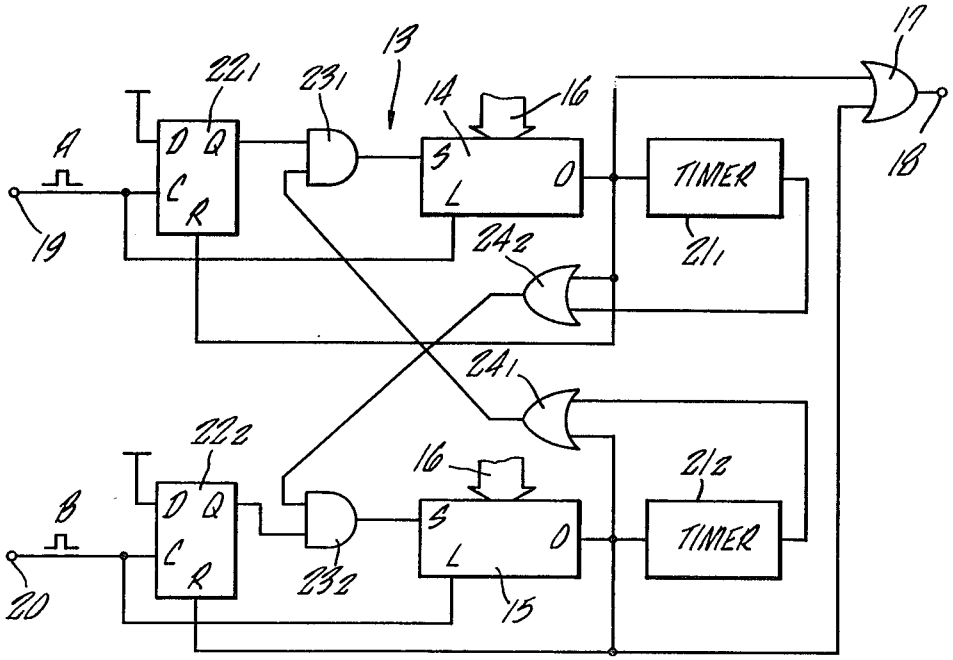
FIG. 2 is a block diagram of the essential portions of the embodiment.

As shown in FIG. 2, the driver circuit 13 comprises a synchronous counter 14 to which the main injection time data is input, and an asynchronous counter 15 to which the increment injection time data is input. Each of the counters 14 and 15 is so constructed as to be loaded with the corresponding injection time data through a data bus 16 upon receiving a high level signal at its L terminal, to be triggered upon receiving a high level signal at its S terminal and then operate for a period of time equal to the injection time data, and to output a pulse of high level to its 0 terminal during the operation. The output sides of both the counters 14 and 15 are connected through an OR circuit 17 to an output terminal 18 which leads to the fuel injection valve 5, so that the injection valve 5 is opened whenever either of the two counters 14 and 15 operates. In the drawing, numeral 19 indicates an input terminal for a synchronous signal A which is generated synchronously to the engine revolutions on the basis of the signal from the crank angle sensor 6, while numeral 20 indicates an input terminal for an asynchronous signal B which is generated at the predetermined time interval asynchronously to the engine revolutions. The synchronous signal A and the asynchronous signal B are directly applied from the input terminals 19 and 20 to the L terminal of the synchronous counter 14 and that of the asynchronous counter 15, respectively. Timers $21_1$ and $21_2$ which add a predetermined period of time t, for example, 1 msec after the ends of the operations of the counters 14 and 15 and produce signals of high level, are connected to the output sides of the counters 14 and 15, respectively. Further, a first D-type flip-flop $22_1$ and a first AND circuit $23_1$ are interposed between the input terminal 19 and the S terminal of the synchronous counter 14, while a second D-type flip-flop $22_2$ and a second AND circuit $23_2$ are interposed between the input terminal 20 and the S terminal of the asynchronous counter 15. In addition, there are disposed a first NOR circuit $24_1$ which receives as its inputs the output of the asynchronous counter 15 and that of the second timer $21_2$ located on the output side thereof, and a second NOR circuit $24_2$ which receives as its inputs the output of the synchronous counter 14 and that of the first timer $21_1$ located on the output side thereof. Thus, the first AND circuit $23_1$ is supplied with the output of the Q terminal of the first D-type flip-flop $22_1$ and the output of the first NOR circuit $24_1$, while the second AND circuit $23_2$ is supplied with the output of the Q terminal of the second D-type flip-flop $22_2$ and the output of the second NOR circuit $24_2$. Each of the D-type flip-flops $22_1$ and $22_2$ is so constructed that, in response to the rise of an input signal to a C terminal, a signal of high level is delivered to the Q terminal, this signal continuing until the output of the corresponding counter 14 or 15 subsequently entering an R terminal falls.

Figure 3:
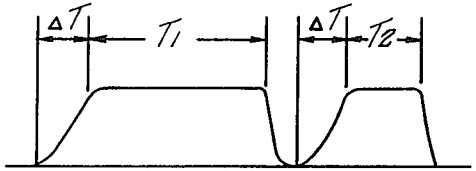
FIG. 3 is a diagram showing pulses which are impressed on a fuel injection valve.

Next, the operation of the above embodiment will be described. When the synchronous signal A is generated, it is input to the L terminal of the synchronous counter 14, and the main injection time data is loaded in the counter 14. Simultaneously, owing to the input of the synchronous signal A to the C terminal of the first D-type flip-flop $22_1$, the output of the Q terminal thereof becomes the high level. In this case, also the output of the first NOR circuit $24_1$ is at the high level ordinarily, so that a signal at the high level is input immediately from the first AND circuit $23_1$ to the S terminal of the synchronous counter 14, in other words, the synchronous signal A is input to the S terminal without a lag. The counter 14 operates for a period of time $T_1+\Delta T$ and delivers a pulse of high level as shown in FIG. 3, and the lag of the rise of the pulse from a low level is compensated by the increase of a pulse width corresponding to T, whereby the fuel injection valve 5 is opened for the desired main injection time $T_1$.

In addition, when the asynchronous signal B is generated during the operation of the synchronous counter 14, it is input to the L terminal of the asynchronous counter 15, and the increment injection time data is loaded in the asynchronous counter 15. Here, since the output of the synchronous counter 14 is at the high level, the output of the second NOR circuit $24_2$ becomes the low level. Thus, even when the input of the asynchronous signal B to the C terminal of the second D-type flip-flop $22_2$ brings the output of the Q terminal thereof to the high level, the output of the second AND circuit $23_2$ remains at the low level, and the asynchronous counter 15 is not operated. Even after the operation of the synchronous counter 14 has ended, the output of the first timer $21_1$ is at the high level during the timekeeping of the first timer $21_1$. Therefore, the output of the second NOR circuit $24_2$ becomes the low level to prevent the asynchronous counter 15 from operating, and the output level of the synchronous counter 14 drops rapidly to the low level, so that the fuel injection valve 5 is closed. When the predetermined period of time t has lapsed since the end of the operation of the synchronous counter 14, the timekeeping of the first timer $21_1$ ends. Then, the output of the second NOR circuit $24_2$ becomes the high level, and the signal of high level is input from the second AND circuit $23_2$ to the S terminal of the asynchronous counter 15. In other words, the input of the asynchronous signal B to the asynchronous counter 15 is delayed until the end of the timekeeping of the first timer $21_1$ by delay means composed of the second D-type flip-flop $22_2$, the second AND circuit $23_2$ and the second NOR circuit $24_2$. Thereafter, the asynchronous counter 15 operates for a period of time $T_2+\Delta T$ and produces a pulse at the high level. On this occasion, the output of the counter 15 rises from the low level, and the lag of the rise is compensated without excess or deficiency by the increase of a pulse width corresponding to $\Delta T$, whereby the fuel injection valve 5 is opened for the desired increment time $T_2$.

In a case where the synchronous signal A is generated during the operation of the asynchronous counter 15, the input thereof to the synchronous counter 14 is delayed until the timekeeping of the second timer $21_2$ ends upon the lapse of the predetermined period of time t since the end of the operation of the asynchronous counter 15, by delay means composed of the first D-type flip-flop $22_1$, the first AND circuit $23_1$ and the first NOR circuit $24_1$. Accordingly, the fuel injection valve 5 is opened for the period of time $T_2$, it is thereafter closed once, and it is opened accurately for the period of time $T_1$. In a case where the timers $21_1$, $21_2$ are off-delay type timers which produce signals of high level even during the operations of the respective counters 14, 15, the outputs of these timers $21_1$, $21_2$ may be input to the respective AND circuits $23_1$, $23_2$ through NOT circuits.

As described above, according to the present invention, even during the operation of one of a synchronous counter and an asynchronous counter, a signal for operating the other is generated, the other counter is not operated unless a predetermined period of time lapses after the end of the operation of one counter. This brings forth the effect that, even when each counter is operated superfluously in correspondence with a correction time for compensating for the lag in the rise of a pulse, a fuel injection valve can be always opened accurately without excess or deficiency, without unnecessarily prolonging the opening time of the fuel injection valve as in the prior art in which the operating periods of time of both the counters are simply added so as to continue the opening of the fuel injection valve.

We claim:

1. In an electronically-controlled fuel injection system having a synchronous counter which receives main injection time data corresponding to an amount of fuel to be injected synchronously to engine revolutions, and an asynchronous counter which receives increment injection time data corresponding to an amount of fuel to be injected at a selected time interval asynchronously to the engine revolutions, wherein the synchronous counter is operated for a period of time equal to the main injection time data upon receiving a synchronous signal which is generated synchronously to the engine revolutions, while the asynchronous counter is operated for a period of time equal to the increment time data upon receiving an asynchronous signal which is generated at the selected time interval, so as to open a fuel injection valve by pulses which are output from the respective counters during the operations thereof, comprising, timer means which add a predetermined period of time after an end of the operation of each of said respective counters, and delay means operating when, during the operation of one of the two counters, a synchronous signal or an asynchronous signal for operating the other counter has been generated for delaying the input of said synchronous signal or asynchronous signal to the other counter until the timer means completes the timing of the addition of said predetermined period of time after the end of operation of said one counter.

2. The system of claim 1 wherein said delay means operates to prevent overlap of said pulses with each other.

3. The system of claim 2 wherein said main injection time data comprises desired synchronous injection time plus a correction time equal to the lag of the rise for each of said pulses, and wherein said increment time data comprises desired asynchronous injection time plus a correction time equal to the lag of the rise for each of said pulses.

* * * * *